US008944259B2

(12) United States Patent
Brough

(10) Patent No.: US 8,944,259 B2
(45) Date of Patent: Feb. 3, 2015

(54) KNIFE BLOCK

(76) Inventor: Michael Winston Brough, Warrington (GB)

( * ) Notice: Subject to any disclaimer, the term of this patent is extended or adjusted under 35 U.S.C. 154(b) by 305 days.

(21) Appl. No.: 13/165,317

(22) Filed: Jun. 21, 2011

(65) Prior Publication Data

US 2012/0324740 A1 Dec. 27, 2012

(51) Int. Cl.
*A47F 7/00* (2006.01)
*A47G 21/14* (2006.01)

(52) U.S. Cl.
CPC ..... *A47G 21/14* (2013.01)
USPC ..... 211/70.7; 211/4; 248/37.3

(58) Field of Classification Search
CPC ..... A47G 21/14; A47J 47/16
USPC ..... 211/4, 70.7, 70.6; 248/551–553, 37.3, 248/37.6; 30/151, 152, 296.1, 299, 1, 124, 30/125, 142, 143, 164, 162, 138, 351
See application file for complete search history.

(56) References Cited

U.S. PATENT DOCUMENTS

| | | | | |
|---|---|---|---|---|
| 4,693,439 | A * | 9/1987 | Hahn | 248/37.6 |
| 5,245,756 | A | 9/1993 | Howell et al. | |
| 5,365,666 | A * | 11/1994 | Gonzalez | 30/340 |
| 6,375,016 | B1 | 4/2002 | Stuchlik, III | |
| 6,619,487 | B2 | 9/2003 | Stuchlik, III | |
| 6,854,186 | B2 * | 2/2005 | Basden et al. | 30/298.4 |
| 2004/0211737 | A1 | 10/2004 | Siegel et al. | |
| 2009/0044796 | A1 * | 2/2009 | Amaral | 126/25 A |

FOREIGN PATENT DOCUMENTS

| | | | |
|---|---|---|---|
| JP | 10192174 | A | 7/1998 |
| JP | 10229941 | A | 9/1998 |
| WO | 2007/048699 | A1 | 5/2007 |

* cited by examiner

*Primary Examiner* — Korie H Chan
(74) *Attorney, Agent, or Firm* — Hodgson Russ LLP

(57) ABSTRACT

A knife storage block comprising a housing block having one or more apertures for accommodating a knife blade, and a security means. The security means is able to adopt a first, opened position in which knives can be removed from the housing block, and a second, closed position in which knives cannot be removed from the housing block. Also described is a knife storage assembly comprising such a knife storage block and one or more knives.

13 Claims, 3 Drawing Sheets

KNIFE BLOCK

BACKGROUND OF THE INVENTION

The present invention relates to a knife storage block for the safe storage of sharp knives, security means for use with a knife housing block and a knife storage assembly comprising a knife storage block and one or more knives.

The present invention relates to securing sharp knives such as kitchen knives in a block made of wood, plastic, stone or some other suitable material. A concern about having sharp knives unsecured is the inappropriate use either by individuals such as small children that might harm themselves or by an intruder that might use them as a weapon. In addition there can be concerns with expensive knives such as those with ceramic blades that they may be stolen.

BRIEF SUMMARY OF THE INVENTION

According to a first aspect of the present invention there is provided a knife storage block comprising:

a housing block having one or more apertures for accommodating a knife blade; and a security means;

wherein the security means is able to adopt a first, opened position in which knives can be removed from the housing block and a second, closed position in which knives cannot be removed from the housing block.

According to a second aspect of the invention there is provided a knife storage assembly comprising a knife storage block of the first aspect and one or more knives.

A third aspect of the invention provides a security means as described in relation the first aspect for use with a housing block.

A fourth aspect of the present invention provides a knife having a blade which is shaped to enable it to interact with the security means when the security means is in the closed position and prevent removal of the knife from the housing block.

Preferred features of the invention will now be described and may be relevant to any aspect where appropriate.

Knife storage blocks are known in the art and the general appearance of the housing block of the present invention will resemble such known blocks.

The housing block comprises one or more apertures for accommodating knives. These apertures are typically narrow slots that are wide enough to accommodate the blade of a knife but too narrow to accommodate the handle. Thus the blade is suitably retained within the aperture (or slot) and the handle rests on the top of the block.

Preferably the housing block has more than one slot, preferably more than two slots, suitably more than three slots, for example from four to ten slots or from four to eight slots.

The knife storage block comprises a security means. This is able to adopt first and second positions relative to the housing block. The security means may be retained within the housing block or it may be located adjacent to it, for example it may be attached to, or rest against an upper surface thereof.

The knife storage assembly of the present invention comprises one or more knives. Suitably the number of knives corresponds to the number of apertures provided in the housing block. Thus the assembly preferably comprises a plurality of knives, suitably from four to eight knives.

Suitably each knife is shaped to engage with the security means when the security means is in the closed position.

In some embodiments the security means may comprise one or more rods which extend through the housing blocks.

The rods may be moved from a first position in which they do not engage with the knives to a second position in which they do engage with the knives. In such embodiments the blade of each knife may suitably be provided with a cut-out section into which the rod may fit when the security device is in the closed position.

In such embodiments the or each rod preferably engages with more than one knife. When a plurality of rods is provided these may be such that they can be moved independently or such that they must be moved together.

In preferred embodiments the security means comprises a security plate. The security plate preferably comprises one or more apertures. Suitably it comprises the same number of apertures as the housing block. Preferably the security plate comprises apertures of substantially the same cross-sectional size and shape as those provided in the housing block. Thus in preferred embodiments the security plate comprises a plurality of slots which in an opened position are suitably aligned with the slots on the housing block such that a knife may be easily removed from (or inserted into) the block and wherein in a closed position the slots of the security plate are not aligned with the slots of the housing block such that a knife cannot be removed.

In such embodiments the blade of each knife of the knife storage assembly is preferably shaped to include a projection which extends from the blade such that when the security plate is in the closed position the projection engages with the plate and prevents withdrawal of the knife from the storage block. Suitably the projection is in the plane of the blade. Preferably the projection extends in a substantially perpendicular direction to the length of the handle.

In especially preferred embodiments of the present invention the blade of each knife is connected to the handle in an "S" shape. This "S" shape provides a lateral projection substantially perpendicular to the handle and this portion of the blade is retained within the block when the security plate is in the closed position.

The security plate may be located within the housing block. Preferably it is provided on top of the housing block. The security plate is able to move relative to the housing block. Preferably is it able to slide between the first and second positions.

Suitably the knife storage assembly comprises a housing block having a security plate which covers the housing block and which slides between the first and second positions assisted by rollers set in the block, to retain or release the knives from the interior.

Preferably the knife storage block of the present invention is further provided with locking means. The locking means suitably enable the security means to be locked in the closed position such that it cannot be moved into the open position without opening the locking means. The locking means may be opened and closed by use of a key, a security code or other suitable mechanism. Any suitable locking means can be used and such means are known to the person skilled in the art.

In some embodiments the locking means may be provided by a barrel lock. This may suitably move a security plate between first and second positions with a cam that engages the plate and moves it as the lock is turned with a key to secure or release the knives beneath the plate.

A security plate may be provided with an external extension with a hole in it that can be used to move it between first and second positions manually, to secure or release the knives beneath the plate and can be locked in position with a padlock when aligned with an identical extension of the housing block.

In some embodiments the security plate may be provided with an external extension that can be used to move it between the first and second positions manually to secure or release the knives beneath the plate and can be locked with a combination lock attached to the block.

Thus the present invention provides a simple mechanism that prevents knives from being withdrawn from a knife block and can be secured with locking means.

The knife block can also be fixed to a suitable surface to prevent the removal of the block and contents.

BRIEF DESCRIPTION OF THE DRAWINGS

The invention will now be further described by way of non-limiting example with reference to the accompanying drawings in which.

DETAILED DESCRIPTION OF THE INVENTION

Figure 1:
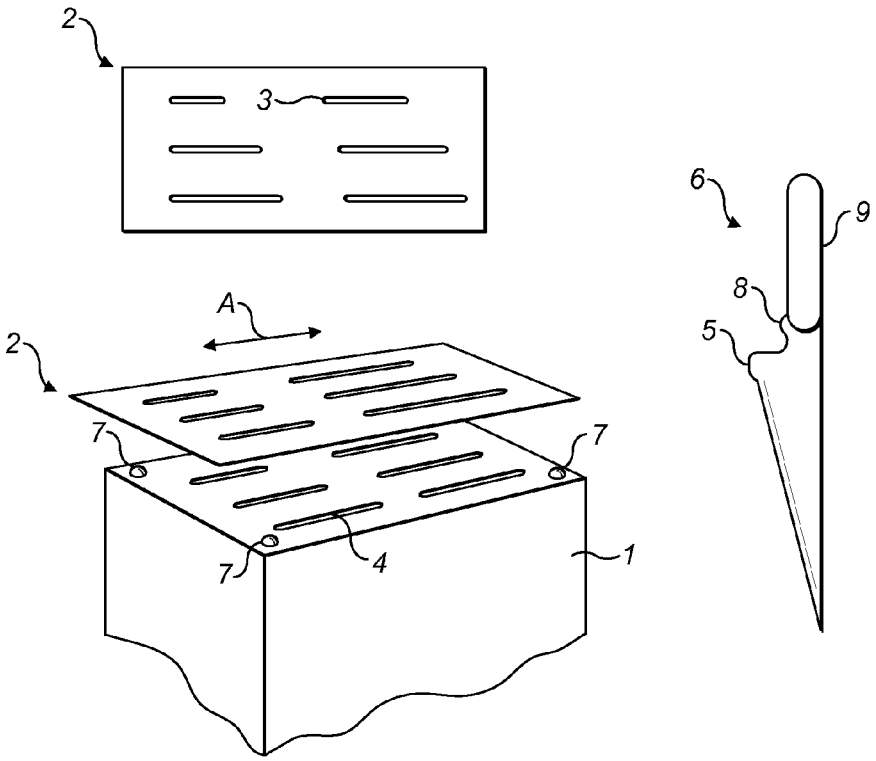
FIG. 1 shows an expanded view of a knife storage assembly of the present invention.

The basic operation of a knife storage block of the invention may be described in relation to FIG. 1. Inside or attached to the housing block (1), at the top end of the device, there is a security plate made of rigid material such as metal or plastic with slots (3) of identical dimensions and aligned to match up with slots (4) in the block. The plate (2) has the capability to move forwards and backwards at right angles to the slots cut in the block such that it either lines up with them or, as it moves to one side, to partially cover each of the slots. The movement of the plate is just sufficient to cover the projection (5) of each knife (6) and can be assisted by rollers (7) to ensure smooth movement.

When each knife is in situ in the block the lateral extension (5) of the knife blade beneath the handle is designed to sit just below the line of the moveable plate. As the plate is moved to partially occlude the slots at the top of the block it covers the lateral extension of the blade and thus prevents the knife from being removed from the block.

The moveable plate (2) has slots of the same dimensions as the knife block and when they are aligned with the slots in the block they permit the knife (6), with an "S" shaped extension (8), to be inserted into the block. The handle (9) of the knife rests on the top of the block and the portion of the blade formed into the "S" shape is retained within the block. As the plate is moved forwards as shown by an arrow A the slots cut into the block are no longer aligned and the slots in the block are partially covered. This arrangement prevents the knife (6) from being withdrawn from the block. As the plate is moved back to the original position the slots in the plate and those in the block are once again aligned and the knife (6) can be removed from the block. The movement of the plate can be assisted with rollers (7) inserted into the top surface of the block.

Figure 2:
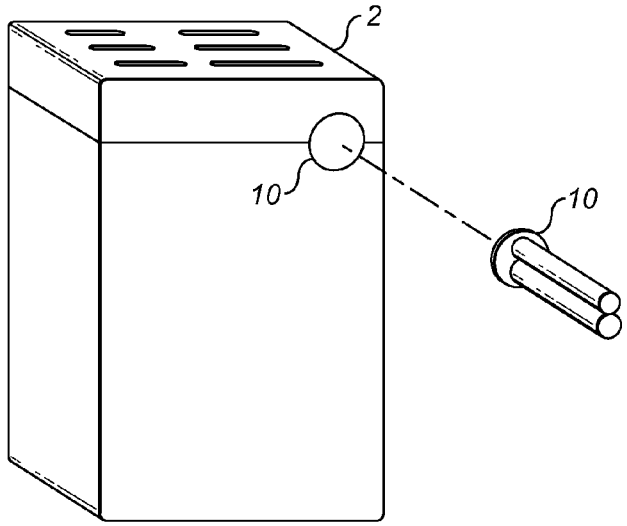
FIG. 2 shows the assembled block of FIG. 1.

A basic form of the assembled block of FIG. 1 is depicted in FIG. 2. The movement of the plate (2) can be implemented by using a cam attached to a cylinder barrel lock (10) and so the dual functions of retaining the knives and securing them can be performed by the action of rotating the lock with a key.

Figure 3:
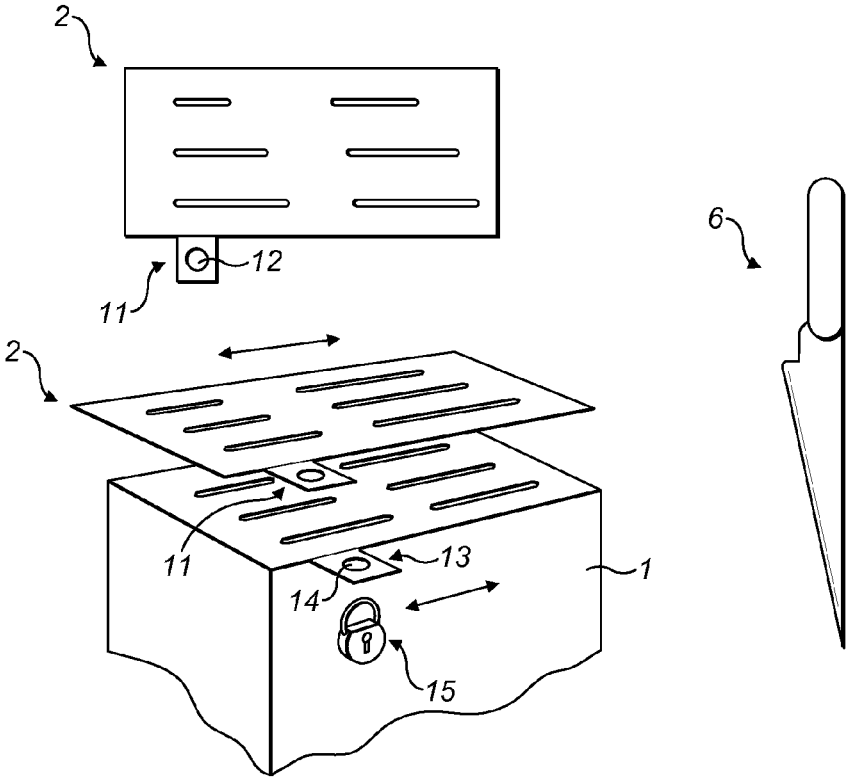
FIG. 3 shows an alternative method of moving plate (2) and securing it.

FIG. 3 shows an alternative method of moving plate (2) by moving it manually using an extension of the plate (11) with a central hole (12) that protrudes through the side of the block. This can be slid backwards and forwards manually to either align the plate with the slots in the block or to partially occlude them and thus retain the knife (6) within the block.

An attachment (13) to the block identical in dimensions to the extension (11) of plate (2), is also equipped with a central hole (14) and this can be matched with the one attached to the plate so that the holes line up. In this position the plate will partially cover the slots cut into the block and thus retain any knife contained within. A simple padlock (15) can be secured through the holes in the extensions of plate (2) and the block to lock the plate in place and retain the knives within the block.

Figure 4:
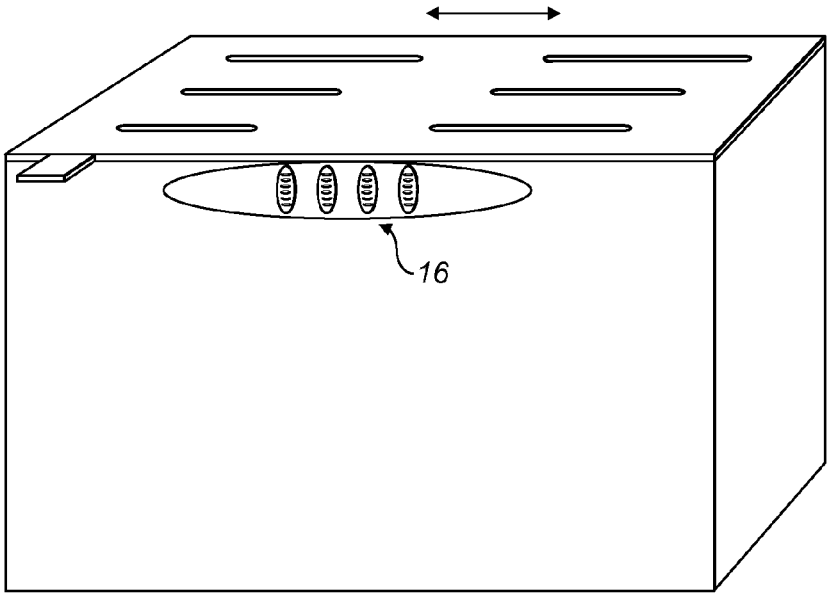
FIG. 4 shows the use of a combination lock to secure a knife storage block of the present invention.

The plate (2) can also be secured using a combination lock (16) as shown in FIG. 4. As the dials on the lock are rotated, pins on the mechanism are located or withdrawn from plate (2). In the position where the pins are withdrawn the plate is free to be moved forwards and backwards manually to secure or release the projection of the knives below the plate.

Figure 5:
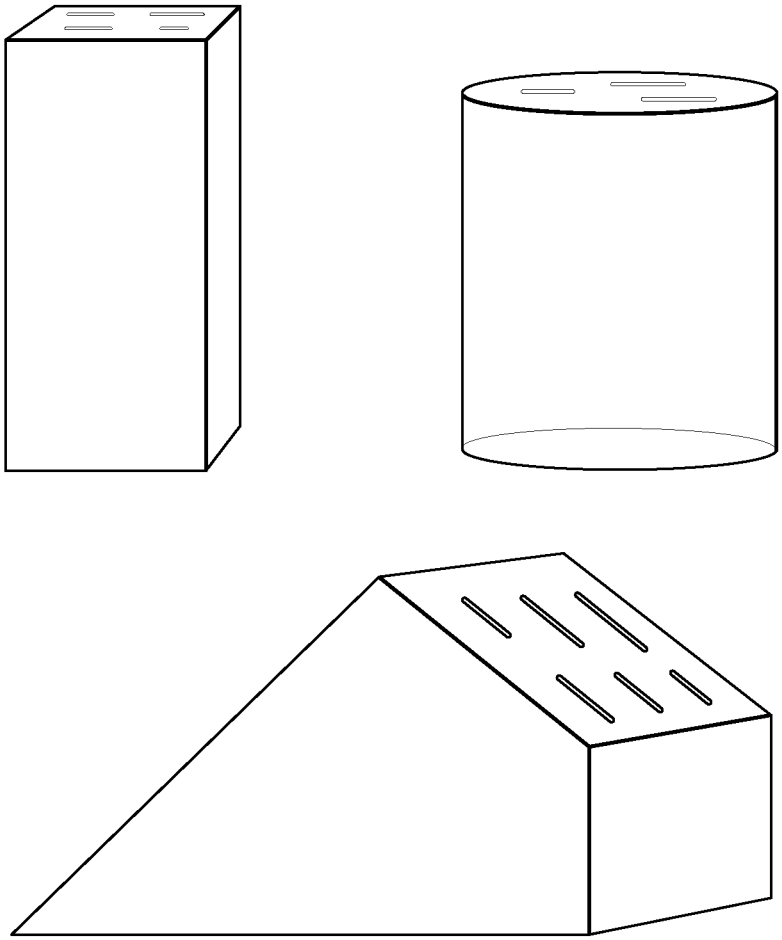
FIG. 5 shows examples of various shapes possible for the knife storage block of the invention.

The knife storage block of the invention can be formed into various shapes and sizes, such as those shown in FIG. 5.

The invention claimed is:

1. A knife storage block comprising:

a housing block having one or more apertures for accommodating a knife blade; and a security means;

wherein the security means is able to adopt a first, opened position in which knives can be removed from the housing block and a second, closed position in which knives cannot be removed from the housing block; the security means comprises a security plate comprising apertures of substantially the same cross-sectional size and shape as the apertures provided in the housing block; and the security plate is located adjacent to the housing block as an outermost surface of the knife storage block.

2. A knife storage block according to claim 1 wherein the housing block comprises more than two apertures.

3. A knife storage block according to claim 1 which is further provided with locking means.

4. A knife storage assembly comprising a knife storage block according to claim 1 and one or more knives.

5. A knife storage assembly according to claim 4 wherein the number of knives corresponds to the number of apertures provided in the housing block.

6. A knife storage assembly according to claim 4 wherein each of the knives is shaped to engage with the security means when the security means is in the closed position.

7. A knife storage assembly according to claim 6 wherein each of the knives includes a projection which extends in a direction which is substantially perpendicular to a length of a handle.

8. A security means as described in claim 1 for use with a housing block.

9. A knife having a blade which is shaped to enable the blade to interact with the security means described in claim 1 when the security means is in the closed position and thus prevents removal of the knife from the housing block.

10. A knife storage block according to claim 1 wherein the security plate is attached to an upper surface of the housing block.

11. A knife storage block according to claim 1 wherein the security plate is slideable relative to the housing block between the first and second positions.

12. A knife storage block according to claim 1 wherein at least one roller is provided between the security plate and the housing block.

13. A knife storage assembly according to claim 7 wherein the projection of each of the knives sits below the security plate when the knife is located in the knife block.

* * * * *